US011623358B2

(12) United States Patent
Hunt et al.

(10) Patent No.: US 11,623,358 B2
(45) Date of Patent: Apr. 11, 2023

(54) SHEATH ASSEMBLY MECHANISM

(71) Applicant: Fiskars Brands, Inc., Middleton, WI (US)

(72) Inventors: Patrick Hunt, Tigard, OR (US); Gregory Shulman, Tualatin, OR (US); Paul Hoover, Portland, OR (US)

(73) Assignee: FISKARS BRANDS, INC., Middleton, WI (US)

( * ) Notice: Subject to any disclaimer, the term of this patent is extended or adjusted under 35 U.S.C. 154(b) by 88 days.

(21) Appl. No.: 16/876,588

(22) Filed: May 18, 2020

(65) Prior Publication Data

US 2020/0384662 A1 Dec. 10, 2020

Related U.S. Application Data

(60) Provisional application No. 62/857,902, filed on Jun. 6, 2019.

(51) Int. Cl.
*B26B 29/02* (2006.01)

(52) U.S. Cl.
CPC ..... *B26B 29/025* (2013.01)

(58) Field of Classification Search
CPC ..... B26B 29/00; B26B 29/02; B26B 29/025; B26B 29/04
USPC ..... 24/262, 578.12, 586.11, 232; 30/151; D7/638; D22/118; D3/220
See application file for complete search history.

(56) References Cited

U.S. PATENT DOCUMENTS 1,242,579 A * 10/1917 Moss ..... F16B 21/06 24/586.11
1,314,688 A * 9/1919 Moss ..... A44B 17/0011 24/586.11
1,402,951 A * 1/1922 Olson ..... A44B 17/0017 24/586.11
2,482,422 A * 9/1949 Loew ..... A44B 15/002 206/37.1

(Continued)

FOREIGN PATENT DOCUMENTS

CN 201701108 U 1/2011
EP 2 363 256 A1 9/2011

(Continued)

OTHER PUBLICATIONS

International Search Report and Written Opinion for International Application No. PCT/IB2020/054698, dated Sep. 10, 2020, 16 pages.

*Primary Examiner* — Jason Daniel Prone
(74) *Attorney, Agent, or Firm* — Foley & Lardner LLP

(57) ABSTRACT

A sheath has a sheath body having a front plate and a back plate spaced apart from the front plate. The front plate and back plate define a cavity within the sheath body. The cavity is externally accessible through an opening formed between the front plate and the back plate. Snapping fasteners are positioned about a front side and a back side of the back plate. The snapping fasteners each include a male component and a female component. The male component and female component of each fastener are mounted on opposite sides of the back plate. The male component includes a protrusion extending away from the sheath body. The female component defines a recess that is complimentary to the protrusion.

18 Claims, 12 Drawing Sheets

(56) References Cited

U.S. PATENT DOCUMENTS 2,672,044 A * 3/1954 Martin ..... A45C 11/324 70/456 R
3,160,936 A * 12/1964 Kapp ..... A63H 33/062 24/586.11
3,400,591 A * 9/1968 Larson ..... G01F 19/002 73/426
3,514,022 A * 5/1970 Eastman ..... B26B 29/025 224/232
3,576,278 A * 4/1971 Eastman ..... B24D 15/084 224/232
4,414,744 A * 11/1983 Collins ..... B26B 29/025 30/151
4,496,088 A * 1/1985 Tuthill ..... A45F 5/02 224/232
D281,896 S * 12/1985 De ..... D3/220
4,759,483 A * 7/1988 Willoughby ..... A45F 5/14 224/232
4,805,818 A * 2/1989 Harrison ..... B26B 29/025 224/232
4,805,819 A * 2/1989 Collins ..... B26B 29/025 224/232
4,835,863 A * 6/1989 Salandre ..... B26B 29/025 30/151
5,002,213 A * 3/1991 Newton ..... B26B 29/025 30/151
5,009,348 A * 4/1991 Derkatz ..... B26B 29/025 224/232
5,155,911 A * 10/1992 Collins ..... B26B 29/025 30/151
D333,728 S * 3/1993 Seber ..... D3/220
5,211,322 A * 5/1993 Nealy ..... B26B 29/025 30/151
5,217,151 A * 6/1993 Parsons ..... A45F 5/021 224/901.4
5,297,341 A * 3/1994 Collins ..... B26B 29/025 30/162
D352,823 S * 11/1994 Chapman ..... B26B 29/025 D3/220
5,388,740 A * 2/1995 Garland ..... B26B 29/025 D3/220
5,441,187 A * 8/1995 Mixson ..... F41C 33/0227 24/586.11
D369,673 S * 5/1996 Morton ..... B26B 29/025 D3/220
5,533,216 A 7/1996 Thier
D378,243 S * 3/1997 Seber ..... F41C 33/0227 D3/220
5,722,130 A 3/1998 Baader
5,926,959 A * 7/1999 Collins ..... B26B 29/025 30/162
6,199,232 B1 3/2001 Kocivar
6,293,448 B1 * 9/2001 Pietrusynski ..... B26B 29/025 224/232
6,854,139 B2 2/2005 Lamy
7,047,776 B2 * 5/2006 Blake ..... E05B 19/00 70/408
7,331,872 B1 * 2/2008 Parsons ..... A45F 5/021 224/195
7,980,979 B2 7/2011 Jakob
8,109,672 B1 * 2/2012 Ackerman et al. .... B65D 33/24 383/37
9,033,148 B2 * 5/2015 Adams ..... B26B 29/025 224/232
9,254,577 B2 * 2/2016 Kommer ..... B26B 29/025
10,933,548 B2 * 3/2021 McKillips ..... B26B 29/02
2013/0227767 A1 9/2013 Bancroft
2017/0043493 A1 * 2/2017 Seber et al. ..... B26B 29/025
2017/0341252 A1 * 11/2017 Hogue ..... B26B 29/025
2018/0200903 A1 7/2018 Robinson et al.
2018/0207827 A1 * 7/2018 Hsieh ..... B26B 3/06
2019/0099904 A1 * 4/2019 Counsellor ..... B26B 29/02

FOREIGN PATENT DOCUMENTS

FR 1398860 A 4/1965
GB 2 558 855 A 7/2018
WO WO-2010/047836 A1 * 4/2010 ..... B26B 29/025
WO WO-2017/027686 A1 2/2017

* cited by examiner

SHEATH ASSEMBLY MECHANISM

CROSS-REFERENCE TO RELATED APPLICATION

This application claims priority to U.S. Provisional Patent Application No. 62,857,902, filed Jun. 6, 2019, the content of which is hereby incorporated by reference in its entirety.

BACKGROUND

The present invention relates generally to the field of sheaths and in particular to the field of sheaths adapted for storing knives or other tools.

SUMMARY

At least one embodiment relates to a sheath. The sheath has a sheath body having a front plate and a back plate spaced apart from the front plate. The front plate and back plate define a cavity within the sheath body. The cavity is externally accessible through an opening formed between the front plate and the back plate. Snapping fasteners are positioned about the back plate of the sheath body. The snapping fasteners each include a male component and a female component. The male component and female component are mounted to opposite sides of the back plate. The male component includes a protrusion extending away from the sheath body. The female component defines a recess that is complimentary to the protrusion.

Another embodiment relates to a sheath. The sheath has a sheath body having a front plate and a back plate spaced apart from the front plate and extending along a longitudinal axis. The front plate and back plate define a cavity, which is externally accessible through an opening formed between the front plate and the back plate. A flange is formed integrally with the back plate of the sheath body and extends outwardly away from each side of the cavity. The flange supports snapping fasteners that extend outwardly away from each side of the flange. The flange further defines elongate recesses that each have a major axis extending approximately parallel to the longitudinal axis.

Another embodiment relates to a sheath assembly. The sheath assembly includes a first sheath and a second sheath. The first sheath has a first sheath body defining a first cavity. The first sheath body also has a first flange extending outwardly from a portion of the first cavity. A first set of snapping fasteners extends outward from each side of the first flange. The second sheath has a second sheath body defining a second cavity. The second sheath body has a second flange extending outwardly along a portion of the second cavity. A second set of snapping fasteners extend outward from each side of the second flange. The first set of snapping fasteners include a first set of male components and a first set of female components. The first set of male components each have protrusions extending outwardly away from the first flange toward the second flange. The second set of snapping fasteners include a second set of male components and a second set of female components. The second set of female components each define recesses that selectively receive the protrusions of the first set of male components to couple the first sheath body to the second sheath body.

This summary is illustrative only and is not intended to be in any way limiting. Other aspects, inventive features, and advantages of the devices or processes described herein will become apparent in the detailed description set forth herein, taken in conjunction with the accompanying figures, wherein like reference numerals refer to like elements.

BRIEF DESCRIPTION OF THE FIGURES

The invention will become more fully understood from the following detailed description, taken in conjunction with the accompanying drawings, in which.

DETAILED DESCRIPTION

Before turning to the figures, which illustrate certain exemplary embodiments in detail, it should be understood that the present disclosure is not limited to the details or methodology set forth in the description or illustrated in the figures. It should also be understood that the terminology used herein is for the purpose of description only and should not be regarded as limiting.

Referring generally to the figures, a modular sheath and sheath assembly are shown. The modular sheaths can each be used to form a stacked sheath assembly, and each include a sheath body that forms an elongated cavity with an opening formed on one end for receiving and storing a knife or tool. Each sheath includes a common coupling mechanism that can be used to create a customizable sheath assembly having different quantities and/or sizes of sheaths. Each sheath within the assembly is removably coupled together so that the type of sheaths, order of the sheaths, and number of sheaths within the assembly can be readily adjusted to create a personalized sheath assembly.

The common coupling mechanism on each sheath includes snapping fasteners positioned in an array about a flange. The snapping fasteners each include male components and female components that are complimentary with one another, and which are positioned on opposite sides of the flange. The male components of each snapping fastener extend forwardly away from the sheath body and are configured to form an interference fit with female components of other snapping fasteners on other sheaths, containers, or tools. The male and female components are mounted coaxially with one another using rivets, for example, which extend through the flange. The opposing male and female components of the snapping fasteners allow a single sheath to be removably coupled to additional sheaths or tools on each of the front and back sides of the sheath body. The flange can further include a secondary coupling mechanism in the form of elongate recesses positioned between the snapping fasteners.

Figure 1A:
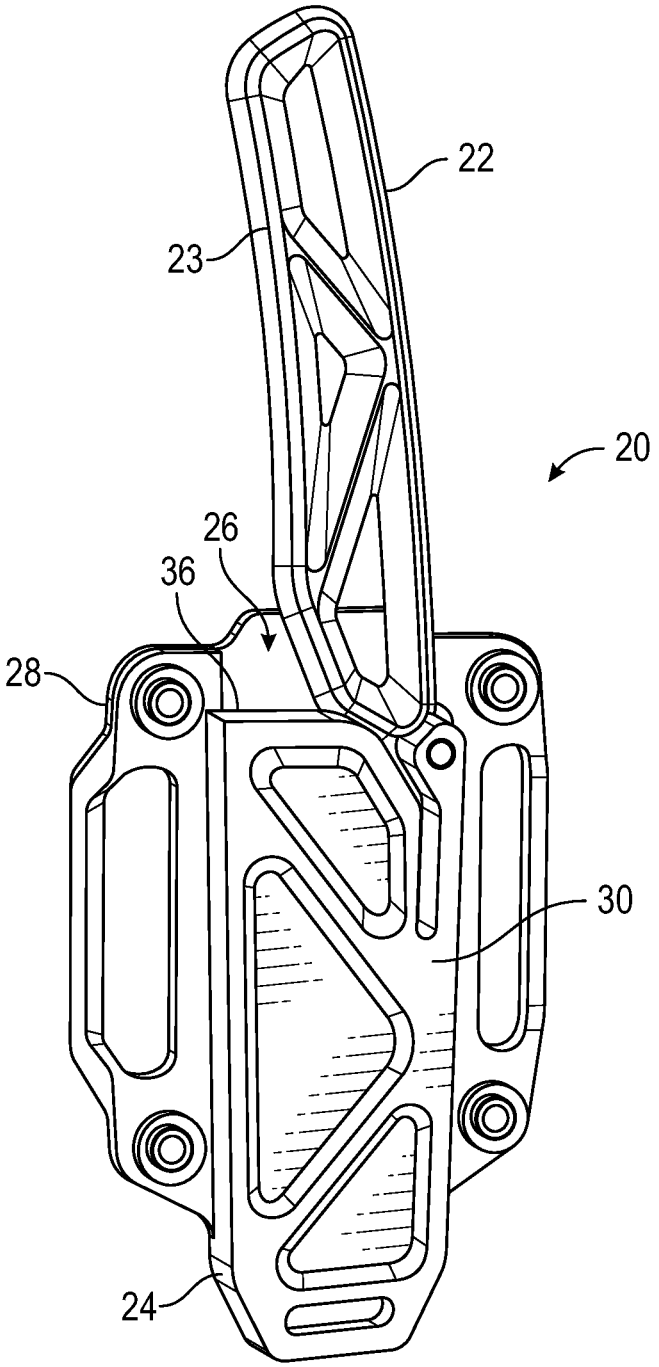
FIG. 1A is a perspective view of a knife received within a sheath, according to an exemplary embodiment.
Figure 1B:
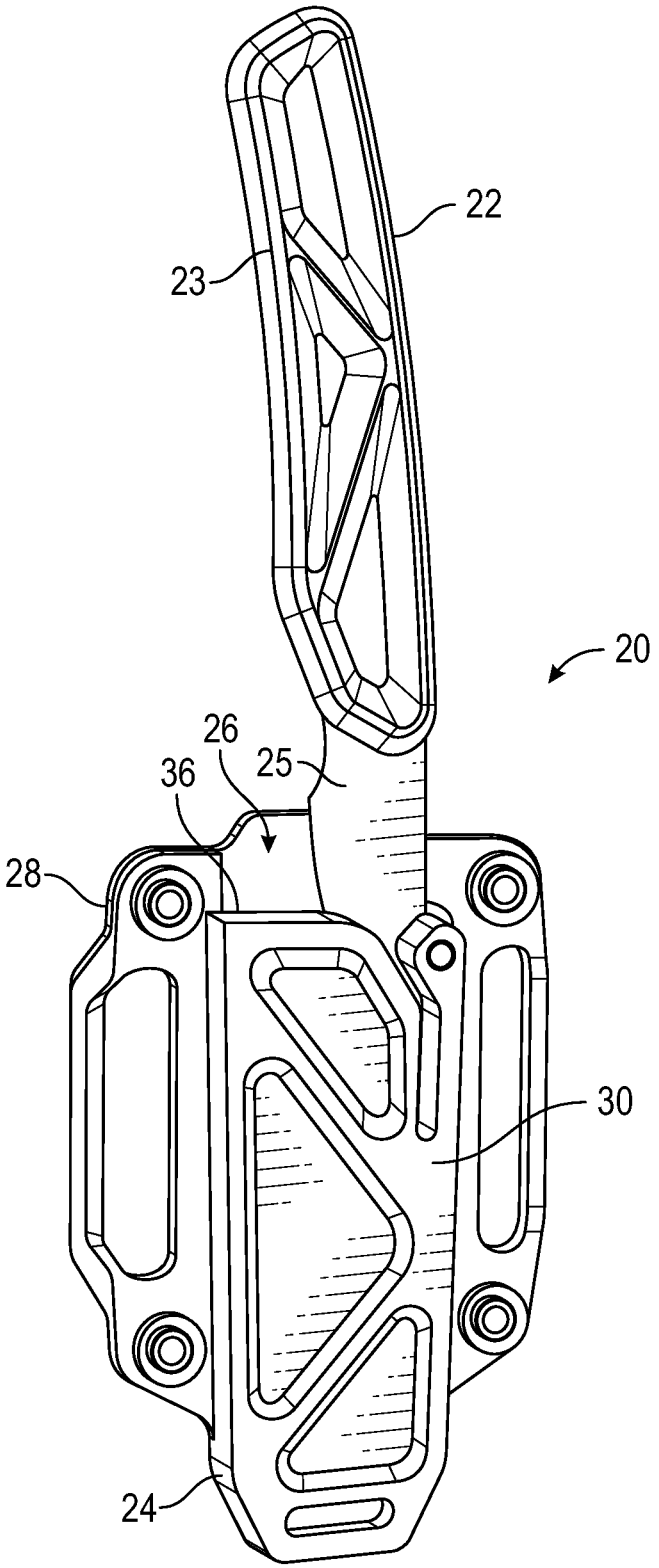
FIG. 1B is a perspective view of the knife of FIG. 1A, partially removed from the sheath.
Figure 2A:
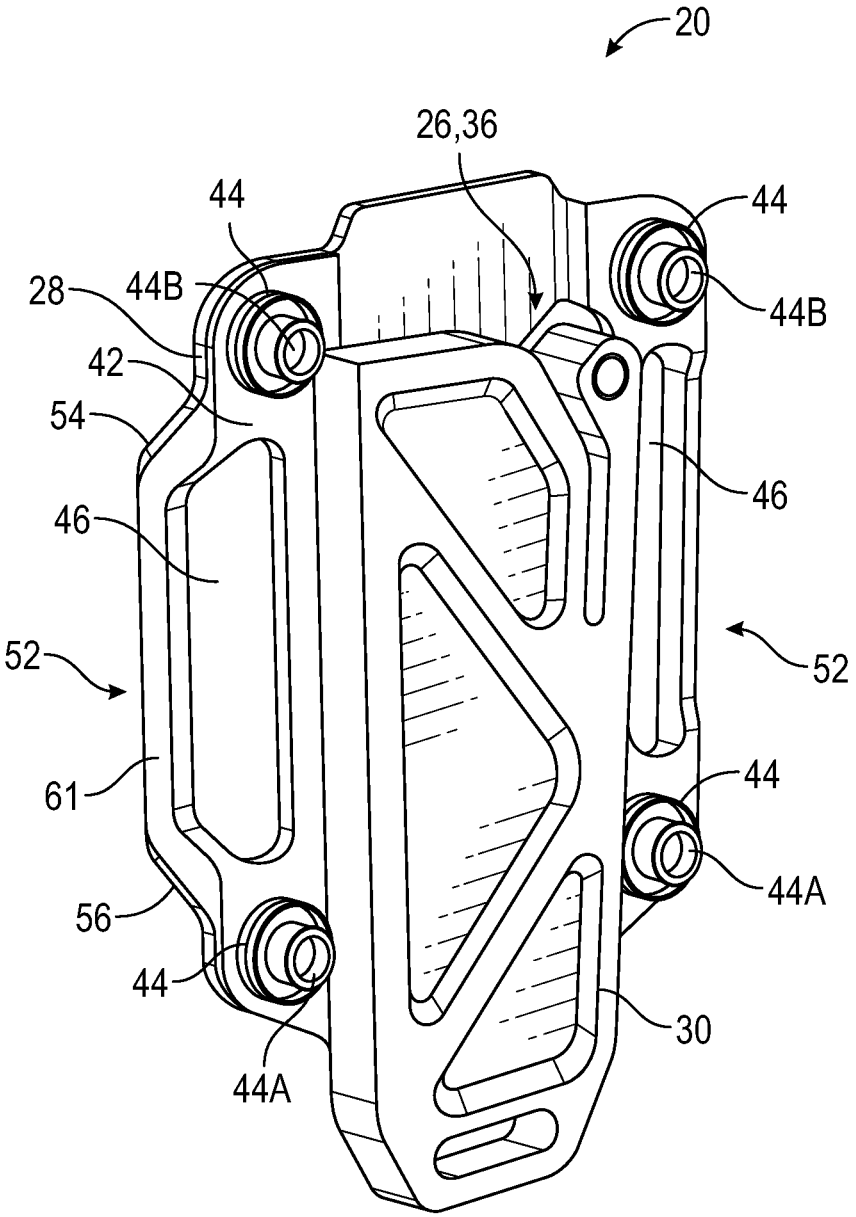
FIG. 2A is a front perspective view of the sheath of FIG. 1A, shown in isolation.
Figure 2B:
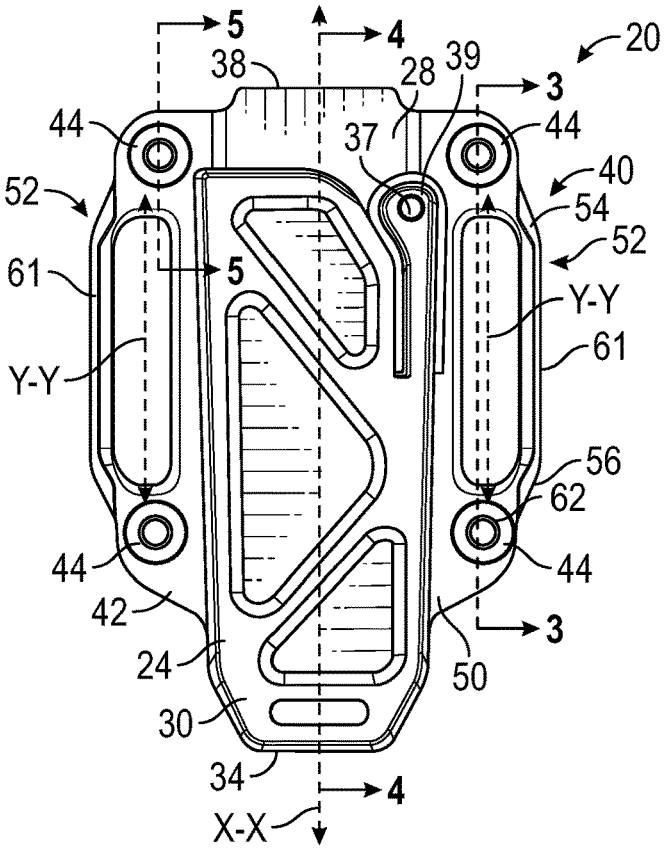
FIG. 2B is a front view of the sheath of FIG. 2A.
Figure 2C:
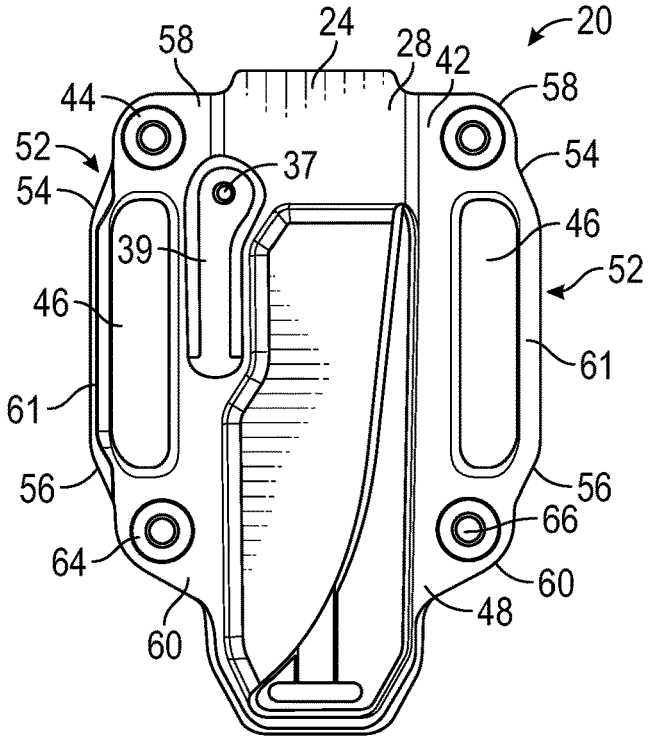
FIG. 2C is a rear view of the sheath of FIG. 2A.
Figure 3:
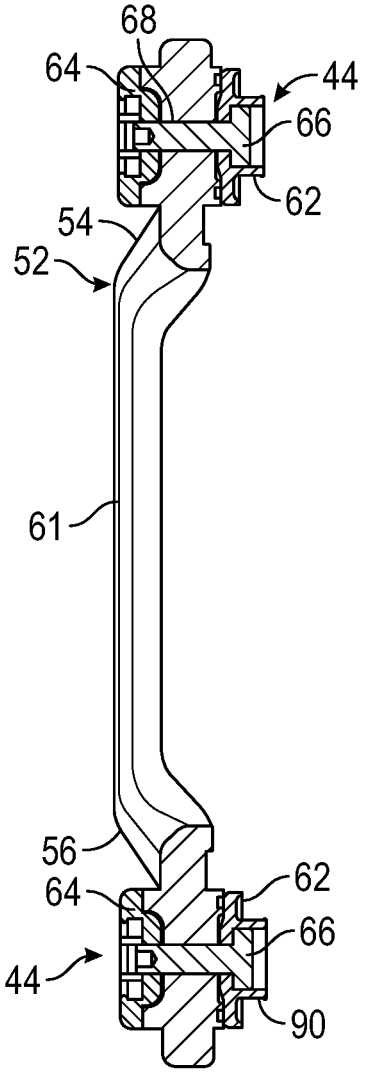
FIG. 3 is a cross-sectional view of the sheath of FIG. 2A, taken along lines 3-3 in FIG. 2B.
Figure 4:
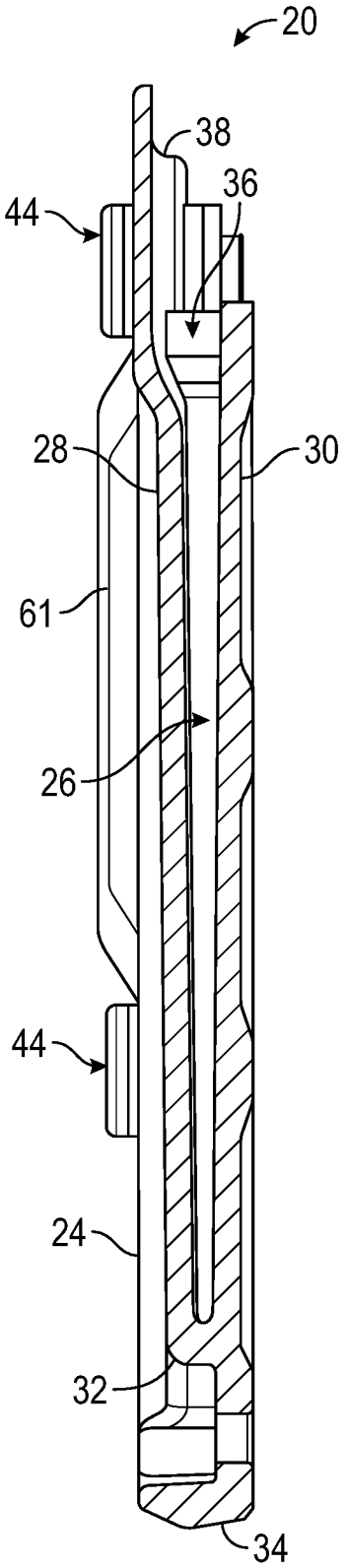
FIG. 4 is a cross-sectional view of the sheath of FIG. 2A, taken along lines 4-4 in FIG. 2B.
Figure 5:
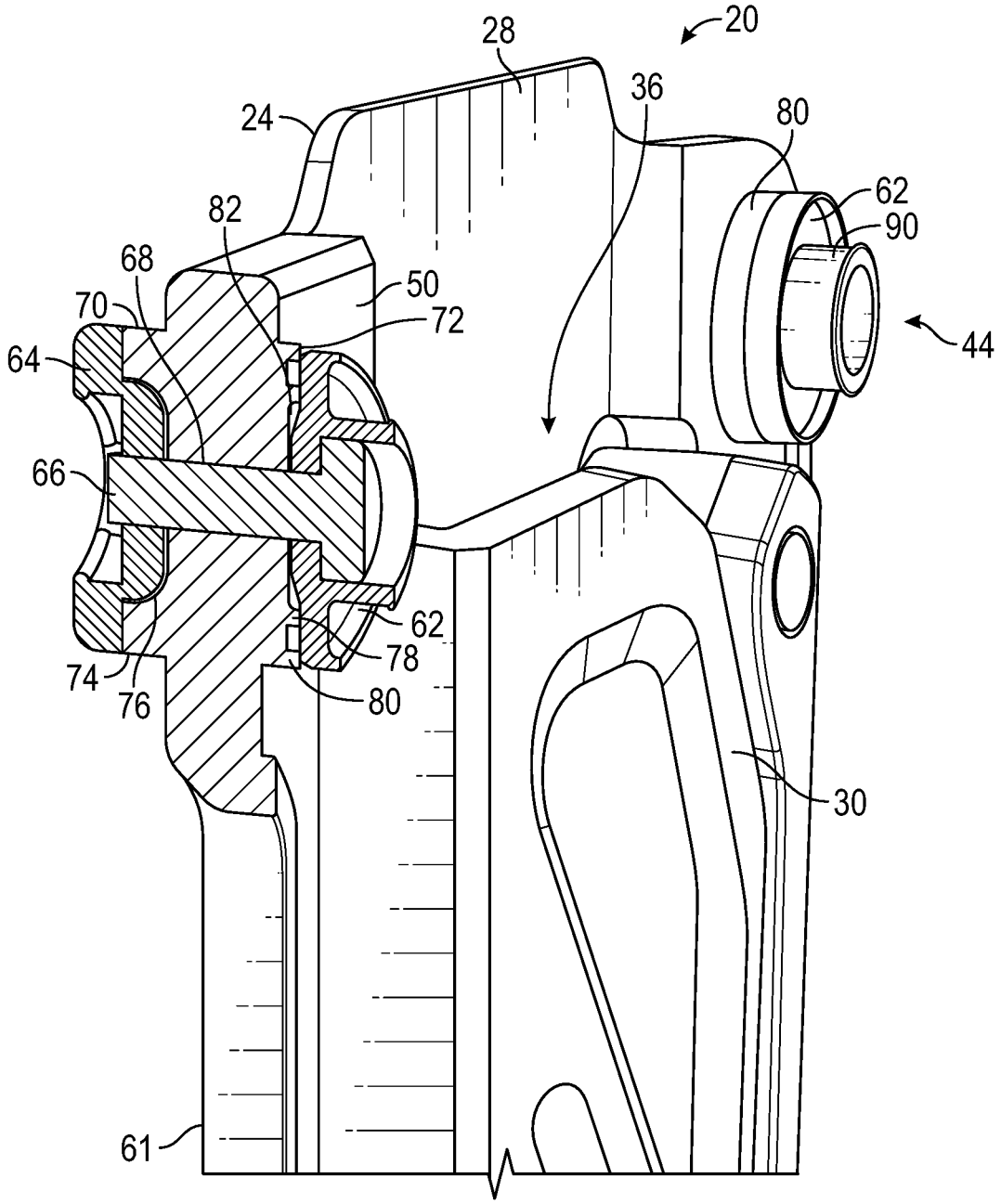
FIG. 5 is a perspective cross-sectional view of the sheath of FIG. 2A, taken along lines 5-5 in FIG. 2B.

Referring to FIGS. 1A and 1B, a sheath 20 receives and stores a knife 22 or other tool having an edge, blade 25, or working surface that is advantageously protected during storage and transport. The sheath 20 includes a sheath body 24 defining and surrounding a cavity 26 within the sheath 20. The cavity 26 is configured to removably receive and store a knife 22, handsaw, multi-tool, or other tool types.

With additional reference to FIGS. 2A-5, the sheath body 24 structure is further defined. The sheath body 24 has a continuous frame molded or otherwise formed to into a shape having a back plate 28 and a raised front plate 30 spaced apart from the back plate 28. The spacing between the raised front plate 30 and back plate 28 defines the cavity 26. The front plate 30 and back plate 28 are coupled to one another (e.g., integrally coupled) and extend away from one another at a base 32 of the cavity 26, which can be formed on or near one end 34 of the sheath body 24. The front plate 30 and back plate 28 each extend away from the base 32, along a longitudinal axis X-X, approximately parallel (e.g., within about 15 degrees) to each other. In some embodiments, the front plate 30 and back plate 28 extend away from the base 32 at a slight acute angle (e.g., between 1 and 15 degrees). The acute angle between the front plate 30 and the back plate 28 creates a tapered cavity 26 that widens as it extends away from the base 32. An opening 36 is formed between the front plate 30 and the back plate 28 opposite the base 32, at or near a second end 38 of the sheath body 24. The opening 36 creates an external access point to the cavity 26 so that a blade 25 or working surface of a tool can be urged into and secured within the cavity 26. An integral biasing element (e.g., a detent 37 formed on or otherwise coupled to a cantilevered arm 39) can be formed within the cavity to secure the blade 25 or working surface within the cavity 26, once it has passed into and through the opening 36. The cavity 26 can be sized so that a portion of a handle 23 of the knife 22 or tool protrudes upwardly beyond the sheath 20, and remains accessible even when the knife 22 or tool is received and secured within the cavity 26.

The sheath body 24 supports a coupling mechanism 40 configured to interface with other sheaths, tools, or belts. The coupling mechanism 40 includes, generally, a flange 42 formed in the back plate 28 of the sheath body 24, snapping fasteners 44 supported by and coupled to the flange 42, and elongate recesses 46 formed within the flange 42. The flange 42 is formed integrally with the back plate 28 and extends outwardly away from each side of the cavity 26 and front plate 30. The flange 42 is substantially symmetrical (e.g., within machining or molding tolerances) about the longitudinal axis X-X. In some embodiments, the flange 42 has a flat rear mounting surface 48 and a flat front mounting surface 50 formed on opposite sides of the back plate 28. The flat mounting surfaces 48, 50 extend parallel to one another and support snapping fasteners 44, as explained in additional detail below. The front plate 30 can form an acute angle relative to the flat mounting surfaces 48, 50, so that the width of the cavity increases away from the base 32.

Arms 52 extend outwardly and backwardly away from each side of the flange 42. The arms 52 can include an angled portions 54, 56 extending away from upper and lower ends 58, 60 of the flange 42 toward one another and to a bridge member 61 spanning between the two angled portions 54, 56. The bridge member 61 extends approximately parallel to the longitudinal axis X-X, and can have a near-constant thickness along its entire length. The arms 52 and flange 42 together define the elongate recesses 46 formed in each side of the back plate 28, with the bridge member 61 defining an outermost portion of each elongate recess 46. The elongate recesses 46 can be used as belt-loops, for example, which allow the sheath body 24 to be supported on or near a waist of a person. The elongate recesses 46 each have a major axis Y-Y extending approximately parallel to the longitudinal axis X-X.

The flange 42 receives and supports snapping fasteners 44. The snapping fasteners 44 are spaced apart from one another about the flange 42, and are configured to both extend into and receive additional snapping fasteners (e.g., snapping fasteners 244, 344, coupled to a second sheath 220 or third sheath 320, shown in FIGS. 10A-10B). In some embodiments, the snapping fasteners 44 are positioned in a rectangular array on the flange 42. Snapping fasteners 44 can be secured to each of the upper and lower ends 58, 60 of the flange 42, above and below each angled portion 54, 56 of the arm, both above and below each elongate recess 46. In some embodiments, the spacing between a bottom pair of snapping fasteners 44A and a top pair of snapping fasteners 44B may differ. For example, the bottom pair of snapping fasteners 44A can be positioned closer together than the top pair of snapping fasteners 44B, which can help ensure that any additional sheaths or tools coupled to the snapping fasteners 44 are properly aligned (e.g., the additional sheaths or tools are positioned right-side up, rather than upside down).

Each snapping fastener 44 includes a male component 62 and a female component 64 mounted on opposite sides of the flange 42. The male component 62 and female component 64 can be coupled to one another using a rivet 66, for example, which extends through a hole 68 formed through the flange 42. The rivet 66 forms an interference fit with each of the male component 62 and female component 64 to securely couple each component 62, 64 together to create each snapping fastener 44 assembly. In some embodiments, bosses 70, 72 are formed in each flat mounting surface 48, 50 of the flange 42 to help locate and secure each component 62, 64 in place upon the flange 42. For example, a first boss 70 can extend away from the flat rear mounting surface 48. The first boss 70 has a generally cylindrical outer wall 74 that surrounds and defines a bore 76. The bore 76 can receive and form a clearance fit with a portion of the female component 64, and can be used to help locate and secure the female component 64 to the flange 42. A second boss 72 can extend away from the flat front mounting surface 50. The second boss 72 can include one or more concentric cylindrical walls 78, 80 extending outwardly away from the flat front mounting surface 50 perpendicular to the longitudinal axis X-X. The inner cylindrical wall 78 can surround and define a second bore 82 that can help locate and secure the male component 62 to the flange 42. In some embodiments, the cylindrical outer wall 74 and cylindrical walls 78, 80 are concentric with one another.

With additional reference to FIGS. 6A-8B, the structure of each snapping fastener 44 is depicted. As indicated previously, each snapping fastener 44 includes a male component 62 and a female component 64 positioned opposite the male component 62 and coupled to the male component 62 using a rivet 66. The male component 62 has a generally annular shape extending around a central axis Z-Z. A body 84 of the male component 62 has a raised lip 86 extending around a perimeter of male component 62 and circumscribing a base 88, which extends inwardly away from the lip 86 toward the central axis Z-Z. A protrusion 90 centered along the central axis Z-Z extends orthogonally away from the base 88, upwardly beyond the raised lip 86. The protrusion 90 can have a generally cylindrical outer shape. In some embodiments, a rim 92 is formed on an end of the protrusion 90. The rim 92 extends radially outward from the generally cylindrical outer shape of the protrusion 90, and can flex, resiliently, relative to the rest of the protrusion 90 to help aid in the coupling process, as explained below.

Figure 6A:
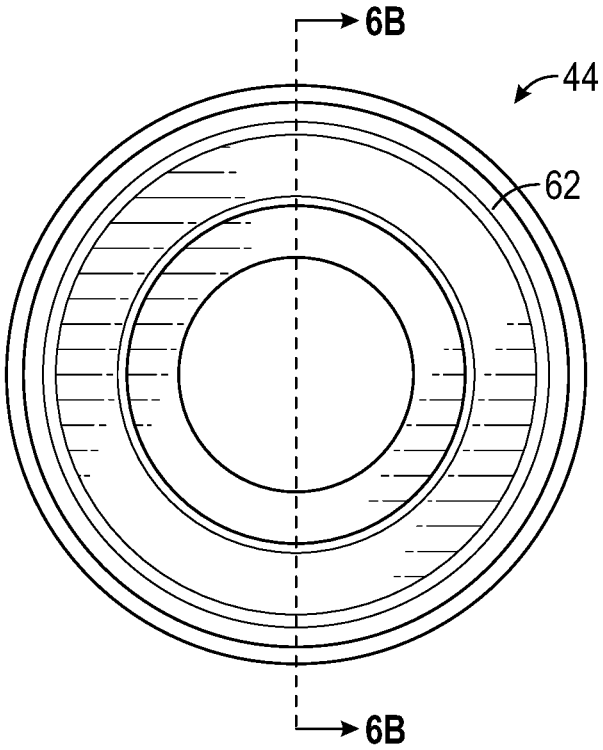
FIG. 6A is a front view of a snapping fastener of the sheath of FIG. 2A.
Figure 6B:
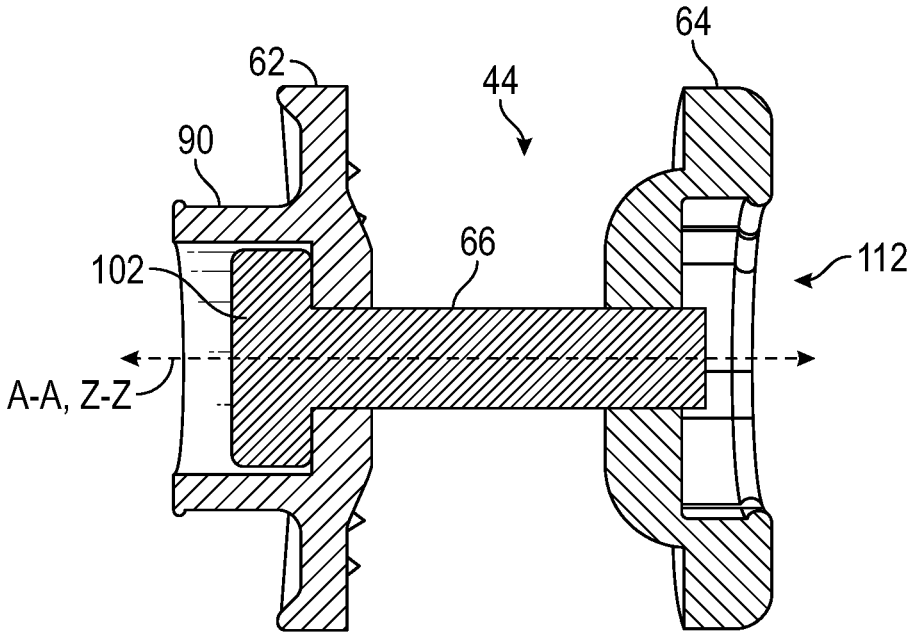
FIG. 6B is a cross-section view of the snapping fastener of FIG. 6A, taken along lines 6B-6B in FIG. 6A.
Figure 7A:
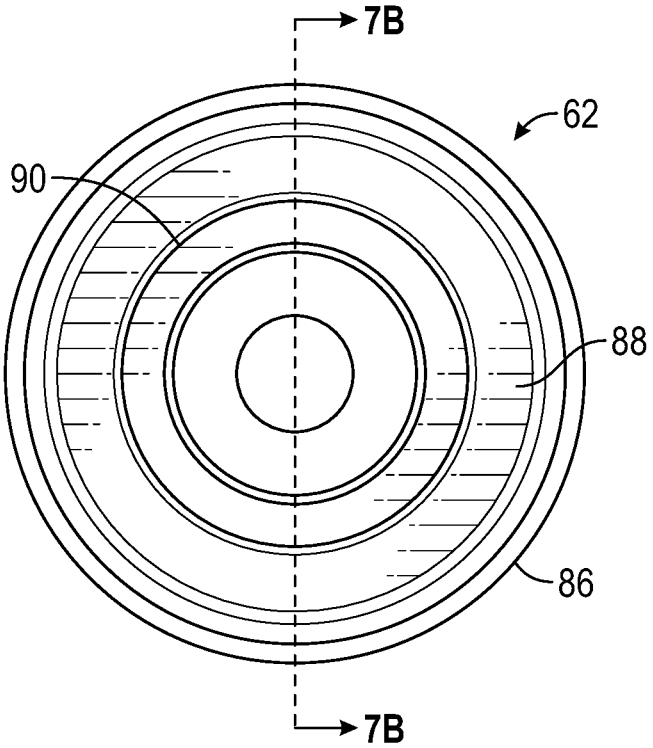
FIG. 7A is a front view of a male component of the snapping fastener of FIG. 6A.
Figure 7B:
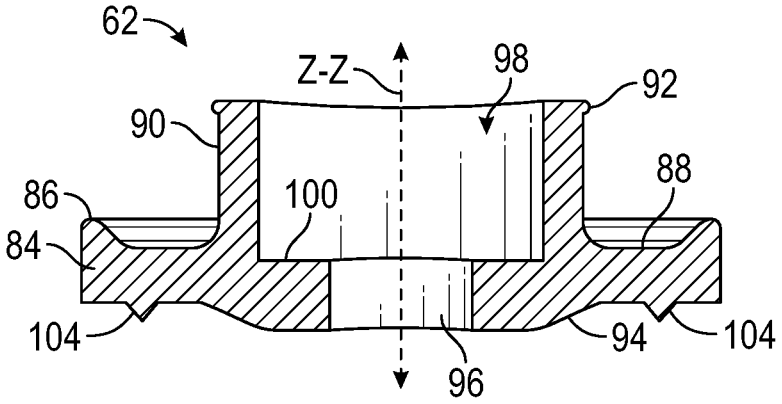
FIG. 7B is a cross-sectional view of the male component of FIG. 7A, taken along lines 7B-7B in FIG. 7A.
Figure 8A:
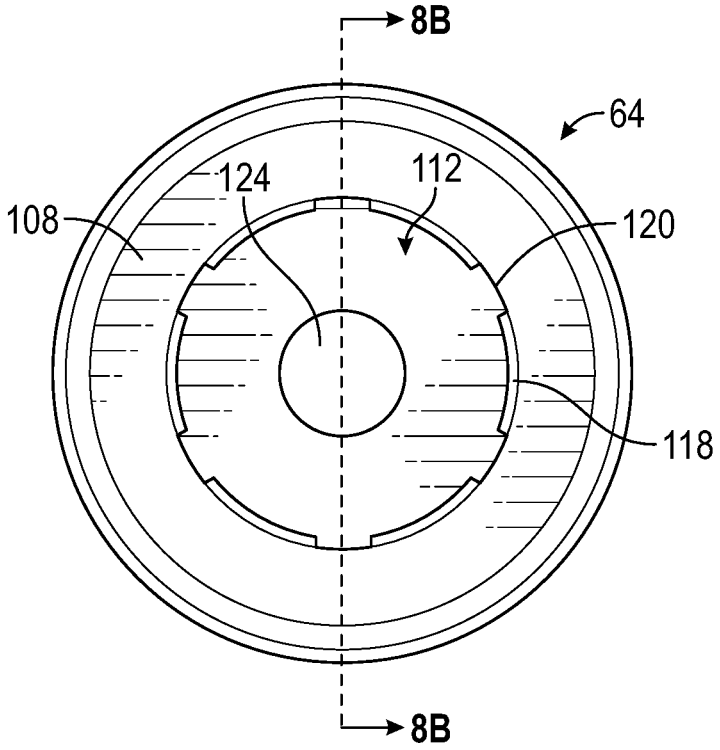
FIG. 8A is a rear view of a female component of the snapping fastener of FIG. 6A.
Figure 8B:
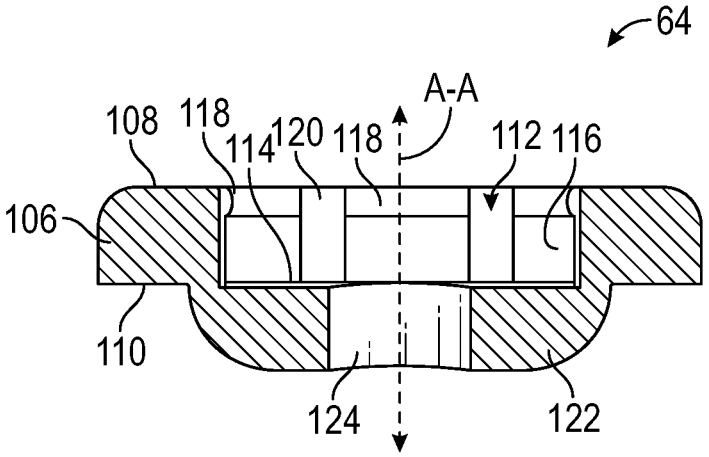
FIG. 8B is a cross-sectional view of the female component of FIG. 8A, taken along lines 7B-7B in FIG. 8A.
Figure 9A:
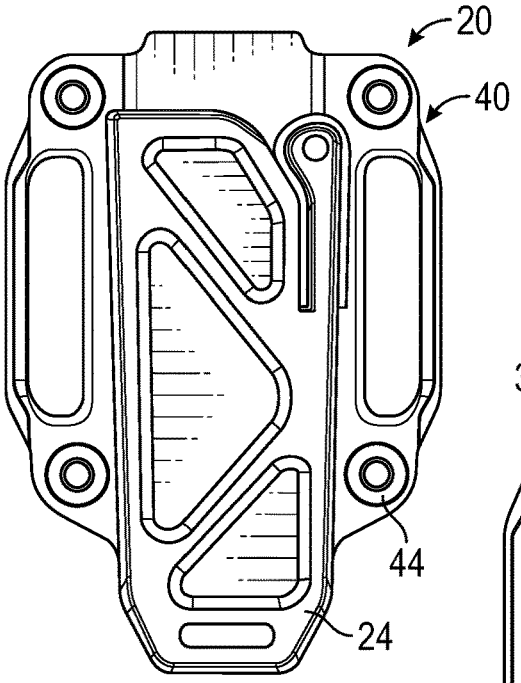
FIGS. 9A-9C are front views of differently-sized sheaths having common coupling mechanisms, according to an exemplary embodiment.
Figure 9B:
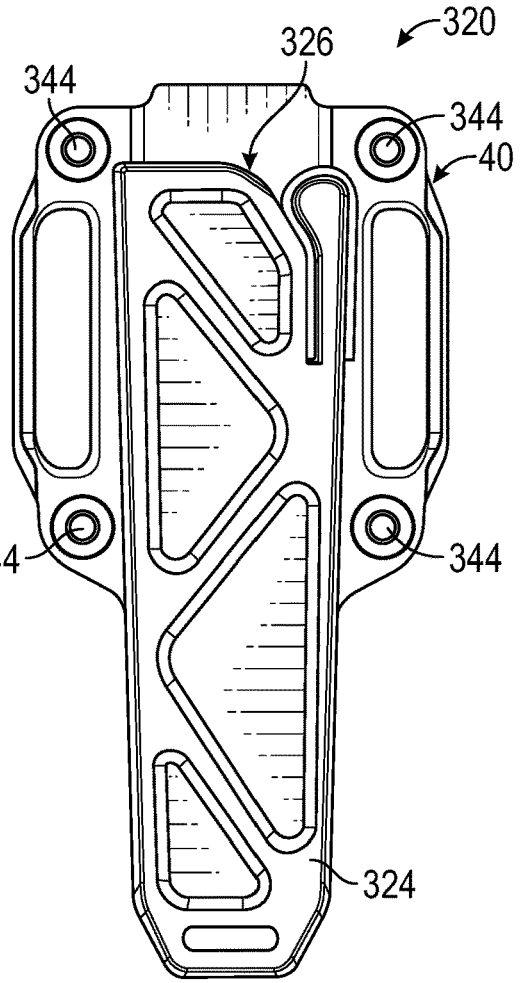
Figure 9C:
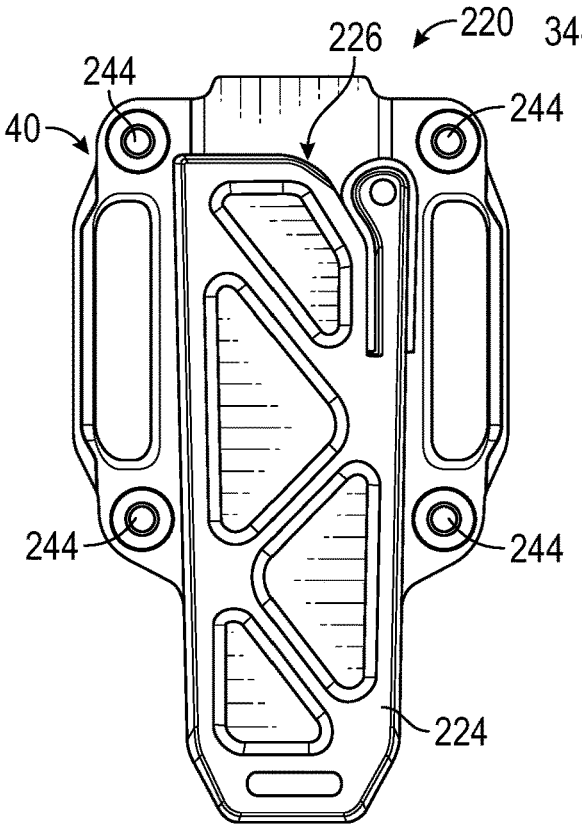

A boss 94 can be formed on the body 84 opposite the protrusion 90 and about the central axis Z-Z. The boss 94 extends away from the base 88 and circumscribes a passage 96 formed through the base 88. The passage 96 opens into a bore 98 formed in the protrusion 90. The bore 98 is defined by a diameter larger than the passage 96, which creates a counterbored hole formed through the body 84. The difference in diameter between the passage 96 and bore 98 forms a seat 100, which can be used to receive and secure a head 102 of the rivet 66, as shown in FIG. 6B. In some embodiments, teeth 104 extend outwardly away from the base 88 of the body 84. The teeth 104 can be positioned in a circular array about the base 88, radially inward from the raised lip 86, and circumscribing the central axis Z-Z. The teeth 104 can engage and secure the male component 62 to the front side of the flange 42.

Like the male component 62, the female component 64 has a generally annular shape extending around a central axis A-A. A body 106 of the female component 64 has a generally cylindrical perimeter extending between a coupling surface 108 and a mounting surface 110. A recess 112 is formed in the coupling surface 108, and extends inwardly to a shoulder 114, which can extend within a plane approximately coplanar with the mounting surface 110. The recess 112 can be defined by a generally cylindrical wall 116 circumscribing the central axis A-A. In some embodiments, a lip 118 extends radially inward from the generally cylindrical wall 116. The lip 118 can form an overhang that extends over a portion of the shoulder 114. The overhang can also resiliently and selectively allow access into the recess 112. In some embodiments, a series of channels 120 are formed in the generally cylindrical wall 116 to divide the lip 118 into several segments that promote additional flexure of the lip 118 relative to the cylindrical wall 116. The channels 120 can extend from the lip 118 downward to the shoulder 114, in a direction parallel to the central axis A-A.

A locating boss 122 can extend away from the mounting surface 110, in a direction opposite from the coupling surface 108. The locating boss can be defined by a generally cylindrical surface as well, which can be configured to sit within the bore 76 formed in the flange 42. A central passage 124 can extend through the locating boss 122, coaxial with the central axis A-A and concentric with the recess 112. In some embodiments, the female component 64 is a continuous component.

The snapping fasteners 44 are secured together on the flange 42 using the rivet 66. During assembly, the locating boss 122 can be positioned within and engaged with the bore 76 and the boss 94 can be positioned within and engaged with the second bore 82 of the flange 42. The rivet 66 can then be passed through each of the male component 62, flange 42, and female component 64. The rivet 66 forms an interference fit with the central passage 124, the hole 68 formed in the flange 42, and the passage 96 formed in the male component 62 to secure each snapping fastener 44 in position. In some embodiments, the head 102 of the rivet 66 is received within the bore 98 and engages the seat 100 to secure the female component 64, male component 62, and rivet 66 together in an assembly.

The male components 62 and female components 64 of the snapping fasteners 44 are configured to receive and couple with additional snapping fasteners 244, 344 having the same size and shape, as shown in FIGS. 9A-10B. The protrusion 90 formed within the male component 62 is configured to fit securely and coaxially within the recess 112 of the female component 64 to create a coupling. When the male component 62 is urged toward the female component 64, the rim 92 initially engages the lip 118 formed over a portion of the generally cylindrical wall 116. The overlap in sizing causes the lip 118 to oppose entry of the rim 92 and protrusion 90, generally, into the recess 112. However, because the rim 92 and lip 118 are each resiliently formed, an axial force of sufficient strength can cause the lip 118 and/or the rim 92 to flex until the protrusion 90 is able to enter into the recess 112. The rim 92 can be defined by a diameter larger than the recess 112, so that the rim 92 engages the cylindrical wall 116 of the recess 112 as it attempts to resiliently return to its resting shape. The natural outward flexure of the rim 92 secures the male component 62 within the female component 64, forming a coupling. The protrusion 90 can be easily removed from the recess 112 by supplying a sufficient axial force in an opposite direction, which causes the lip 118 to flex outward until the rim 92 can be removed from the recess 112.

Using common coupling mechanisms 40, modular sheaths 20, 220, 320 having different body 24, 224, 324 sizes and shapes can be coupled together and arranged in a personalized manner. Each sheath body 24, 224, 324 is equipped with the same coupling mechanism 40, including flanges 42 and snapping fasteners 44, 244, 344 arranged in the same generally rectangular array. The sheaths 20, 220, 320 can each support cavities 26, 226, 326 of different depths that are adapted to receive different sizes and types of knives or tools, and can be ordered in a stacked assembly catering to personal needs of a worker. In some embodiments, sheaths 20, 220, 320 having similarly-sized bodies 24, 224, 324 can be coupled together in a shaft assembly as well.

Figure 10A:
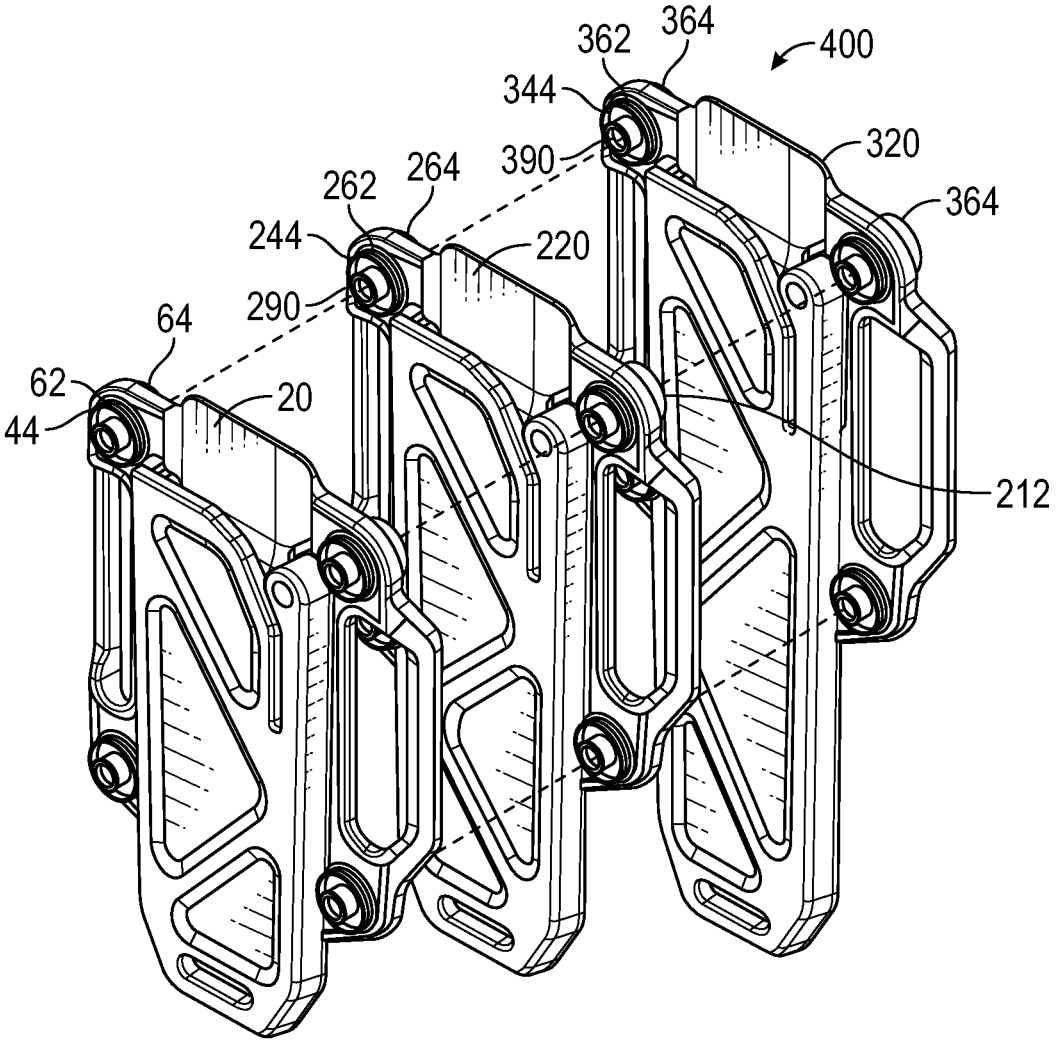
FIG. 10A is an exploded view of a sheath assembly formed of each of the differently sized sheaths of FIGS. 9A-9C.
Figure 10B:
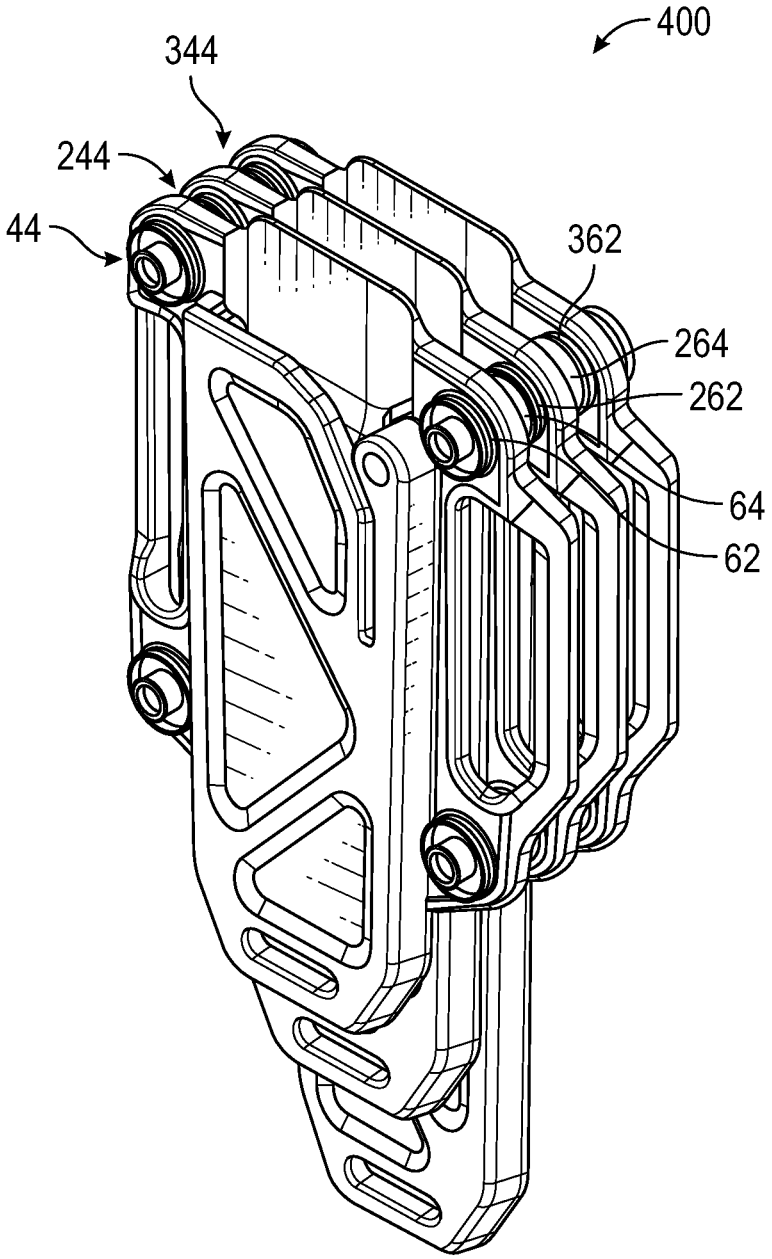
FIG. 10B is a perspective view of each of the sheaths of FIGS. 9A-9C coupled together in a stacked sheath assembly.

As shown in FIGS. 10A-10B, the modular sheaths 20, 220, 320 can be arranged in a stacked sheath assembly 400 by coupling snapping fasteners 44, 244, 344 together in series. For example, the protrusions 390 of each male component 362 on the third sheath 320 can extend into and engage recesses 212 formed in the female components 264 of the snapping fasteners 244 formed on the second sheath 220. Simultaneously, protrusions 290 of the male components 262 of the snapping fasteners 244 each extend into and engage the recesses 112 formed in the female components 64 of the snapping fasteners 44, which creates a stack of three sheaths 20, 220, 320 coupled together. The male components 62 of the first sheath 20 continue to extend outward, and can engage with yet another female component (not shown) to create an even larger stacked sheath assembly 400. Similarly, the female components 364 of the snapping fasteners 344 can receive protrusions from still another set of male components (not shown) to adjust a size of the stacked assembly. The snapping fasteners 44, 244, 344 are each aligned coaxially with one another to create the stacked sheath assembly 400. Although shown as an assembly of three sheaths arranged in a stack, various modifications of the sheath assembly may include more (e.g., 4-5) or less (e.g. 1 or 2) sheaths, which can be modified depending on the needs of a user. Similarly, a stack of two or more of the same sized sheaths (e.g., a stack of two or more sheaths 20) can be coupled together.

The snapping fasteners 44, 244, 344 coupled to each sheath 20, 220, 320 allow a user to quickly couple multiple knife or tool sheaths together in a desired configuration that can be catered to accomplishing individual tasks. The removable couplings formed between each sheath 20, 220, 320 create a modular and customizable sheath that can be arranged in a compact, stacked orientation where each flange 42 and elongate recess 46 are aligned with one another. Different types of sheaths can be coupled together as well, as long as each sheath has the same general coupling mechanism 40 and snapping fastener 44 array. For example, both hard sheaths (e.g., for knifes) and soft sheaths (e.g., for pliers or multi-tools) can be arranged together in a stacked assembly when each sheath is equipped with the same snapping fastener 44 orientation. Accordingly, the front plate 30 and back plate 28 described above can be formed or rigid, semi-rigid, or flexible material, including polymers (e.g., acrylic-polyvinyl chloride compounds, nylon), leather, or other synthetic materials.

The same coupling mechanism 40 and snapping fastener 44 array can be applied directly to tools or other storage mechanisms as well. For example, a flange 42 and rectangular array of snapping fasteners 44 can be positioned about a body of a tape measure (not shown), a hammer, or other tools. Other non-sheath components or accessories can be provided with snapping fasteners 44 as well, including belt clips or attachments, sharpening stones, fire strikers, accessory pouches, external straps, and the like. By providing the common coupling mechanism 40 to each different type of accessory, compact, adjustable, and modular tool assemblies are quickly created in several possible orientations catered to accomplishing specific tasks. For example, a camping tool assembly and a construction tool assembly could each be readily created out of the same set of modular components. In embodiments, the coupling mechanism 40 can be altered as well. For example, each snapping fastener 44, 244, 344 can include two male components 62, 262, 362 (or two female components 64, 264, 364) mounted on opposite sides of the sheath body 24, 224, 324. Alternatively, the female component 64, 264, 364 of each snapping fastener 44, 244, 344 can be mounted to the front mounting surface 50 of the flange 42, while the male component 62, 262, 362 is mounted to the rear mounting surface 48 of the flange 42. In still further examples, snapping fasteners 44, 244, 344 may alternate. The male components 62, 262, 362 of some of the snapping fasteners 44, 244, 344 (e.g., the bottom pair 44A) may be mounted to the front mounting surface 50, while the female components 64, 264, 364 of the other snapping fasteners 44, 244, 344 (e.g., the top pair 44B) are mounted to the front mounting surface 50 as well.

No claim element herein is to be construed under the provisions of 35 U.S.C. § 112(f), unless the element is expressly recited using the phrase "means for."

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above.

The term "or," as used herein, is used in its inclusive sense (and not in its exclusive sense) so that when used to connect a list of elements, the term "or" means one, some, or all of the elements in the list. Conjunctive language such as the phrase "at least one of X, Y, and Z," unless specifically stated otherwise, is understood to convey that an element may be either X, Y, Z; X and Y; X and Z; Y and Z; or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the sheath as shown in the various exemplary embodiments is illustrative only. Additionally, any element disclosed in one embodiment may be incorporated or utilized with any other embodiment disclosed herein. Although only one example of an element from one embodiment that can be incorporated or utilized in another embodiment has been described above, it should be appreciated that other elements of the various embodiments may be incorporated or utilized with any of the other embodiments disclosed herein.

What is claimed is:

1. A sheath, comprising:

a sheath body having a front plate and a back plate spaced apart from the front plate, the front plate and back plate defining a cavity therein, the cavity being externally accessible through an opening formed between the front plate and the back plate; and a plurality of snapping fasteners positioned about the back plate of the sheath body, the plurality of snapping fasteners each including a male component and a female component mounted on opposite sides of the back plate, the male component including a protrusion extending away from the sheath body, and the female component defining a recess complimentary to the protrusion, wherein the male component and the female component of each snapping fastener are coupled together using a rivet extending through the back plate.

2. The sheath of claim 1, wherein in each of the plurality of snapping fasteners, the protrusion of the male component is cylindrical and positioned coaxially with the recess of a corresponding female component.

3. The sheath of claim 1, wherein the back plate is further defined by a flange extending outwardly away from the cavity, and wherein each of the plurality of snapping fasteners are coupled through the flange.

4. The sheath of claim 3, wherein the snapping fasteners are coupled to the flange in a rectangular array straddling the cavity.

5. The sheath of claim 1, wherein a rim of the protrusion is defined by an outer diameter larger than an inner diameter defining the recess.

6. The sheath of claim 1, wherein the protrusion of each male component within the plurality of snapping fasteners is configured to extend into a recess formed in a female component within a second plurality of snapping fasteners supported by a second sheath body, and wherein the recess of each female component within the plurality of snapping fasteners is configured to receive a protrusion of a male component within a third plurality of snapping fasteners supported by a third sheath body simultaneously.

7. The sheath of claim 6, wherein each snapping fastener in the plurality of snapping fasteners, each snapping fastener in the second plurality of snapping fasteners, and each snapping fastener within the third plurality of snapping fasteners are approximately equally sized and configured to stack with one another in series.

8. A sheath comprising:

a sheath body having a front plate and a back plate spaced apart from the front plate extending along a longitudinal axis, the front plate and back plate defining a cavity therein, the cavity being externally accessible through an opening formed between the front plate and the back plate; and a flange formed integrally with the back plate and outwardly away from each side of the cavity, supporting snapping fasteners extending outwardly away from a front side and a back side of the flange, the flange defining elongate recesses each having a major axis extending approximately parallel to the longitudinal axis, wherein the male component and female component of each snapping fastener are coupled together by a rivet extending through the flange.

9. The sheath of claim 8, wherein the flange is substantially symmetrical about the longitudinal axis.

10. The sheath of claim 8, wherein the flange includes a flat rear mounting surface forming a first portion of the back plate and a flat front mounting surface forming a second portion of the back plate opposite the first portion, and wherein the front plate forms an acute angle with the flat front mounting surface.

11. The sheath of claim 10, wherein an arm angles outwardly and rearwardly away from each side of the flat rear mounting surface, each arm defining an outermost portion of the elongate recess.

12. The sheath of claim 8, wherein each of the snapping fasteners include a male component mounted to a front side of the rear plate and a female component mounted to a back side of the rear plate, the male component comprising a protrusion extending away from the flange and the female component defining a recess formed therein.

13. The sheath of claim 12, wherein the snapping fasteners are positioned about the flange in a rectangular array.

14. A sheath assembly comprising:

a first sheath comprising:

a first sheath body defining a first cavity therein, the first sheath body having a first flange extending outwardly along a portion of the first cavity and a first plurality of snapping fasteners extending outward from each side of the first flange; and a second sheath comprising:

a second sheath body defining a second cavity therein, the second sheath body having a second flange extending outwardly along a portion of the second cavity and a second plurality of snapping fasteners extending outward from each side of the second flange;

wherein the first plurality of snapping fasteners include a first plurality of male components and a first plurality of female components, the first plurality of male components each having protrusions extending outwardly away from the first flange toward the second flange, the second plurality of snapping fasteners include a second plurality of male components and a second plurality of female components, the second plurality of female components each defining recesses formed therein and selectively receiving protrusions of the first plurality of male components to couple the first sheath body to the second sheath body, such that the first sheath body is prevented from rotating with respect to the second sheath body when the second plurality of female components receives the protrusions of the first plurality of male components to couple the first sheath body to the second sheath body, wherein each of the first plurality of male components and each of the first plurality of the female components are individually coupled together using a rivet extending through the first flange.

15. The sheath assembly of claim 14, wherein the first sheath and the second sheath are approximately equal in size and the first sheath body and second sheath body are aligned in a stacked orientation.

16. The sheath assembly of claim 14, wherein the first cavity and second cavity are defined by different depths and a first opening to the first cavity and a second opening to the second cavity are vertically aligned.

17. The sheath assembly of claim 14, further comprising:

a third sheath comprising:

a third sheath body surrounding and defining a third cavity therein, the third sheath body having a third flange extending outwardly along a portion of the third cavity and a third plurality of snapping fasteners extending outward from each side of the third flange, the third plurality of snapping fasteners including a third plurality of male components and a third plurality of female components, the third plurality of female components each defining recesses formed therein and selectively receiving protrusions of the second plurality of male components to couple the first sheath body, second sheath body, and third sheath body together in a stacked orientation.

18. The sheath assembly of claim 17, wherein each of the first sheath body, second sheath body, and third sheath body are defined by different lengths along a longitudinal axis.

* * * * *